US012274356B1

(12) United States Patent
Che et al.

(10) Patent No.: US 12,274,356 B1
(45) Date of Patent: Apr. 15, 2025

(54) JIGSAW PUZZLE TABLE

(71) Applicant: Xiaoling Che, Hubei (CN)

(72) Inventors: Xiaoling Che, Hubei (CN); Xiaoyi Che, Hubei (CN); Jinyan Duan, Guangdong (CN)

(73) Assignee: Xiaoling Che, Dangyang (CN)

( * ) Notice: Subject to any disclaimer, the term of this patent is extended or adjusted under 35 U.S.C. 154(b) by 0 days.

(21) Appl. No.: 18/764,239

(22) Filed: Jul. 4, 2024

(30) Foreign Application Priority Data

Apr. 29, 2024 (CN) ..... 202420950719.0

(51) Int. Cl.
*A47B 25/00* (2006.01)
*A47B 3/08* (2006.01)
*A47B 13/08* (2006.01)

(52) U.S. Cl.
CPC ..... *A47B 25/00* (2013.01); *A47B 3/08* (2013.01); *A47B 13/08* (2013.01)

(58) Field of Classification Search
CPC ..... A47B 25/00; A47B 3/08; A47B 3/091; A47B 13/08
USPC ..... 108/27, 127, 129, 130, 132
See application file for complete search history.

(56) References Cited

U.S. PATENT DOCUMENTS 1,203,783 A * 11/1916 Reischmann ..... A47B 3/0815 5/315.2
1,669,799 A * 5/1928 Kern ..... A47B 3/0917 108/132
1,959,725 A * 5/1934 Lindsay ..... A47B 3/0815 108/132
1,964,759 A * 7/1934 Howe ..... A47B 3/0911 108/130
2,553,887 A * 5/1951 Balabushka ..... A47B 3/08 403/113
2,653,066 A * 9/1953 Anderson ..... A47B 3/0815 108/129
3,271,075 A * 9/1966 Good ..... A47C 16/02 297/423.41
4,383,488 A * 5/1983 Macho ..... A47B 3/0812 108/130
4,573,415 A * 3/1986 Ramey ..... A47B 3/0815 248/188
6,494,419 B2 * 12/2002 Pai ..... F16M 11/38 108/157.15
6,568,506 B1 * 5/2003 Donnalley ..... A47C 12/02 182/33
7,055,563 B2 * 6/2006 Logan ..... B25H 1/04 144/287
8,496,289 B2 * 7/2013 Chen ..... A47B 3/083 108/130
10,035,255 B2 * 7/2018 Cindric ..... B25H 1/10
11,452,368 B1 * 9/2022 Li ..... A47B 3/08
(Continued)

*Primary Examiner* — Jose V Chen

(57) ABSTRACT

A jigsaw puzzle table includes: a table body; at least two support legs, wherein, each of the at least two support legs is rotatably connected to the table body; in a first state, each support leg is inclined with respect to the table body and supports the table body; at least two support blocks, wherein, each of the at least two support blocks is disposed on a respective one of the at least two support legs or on the table body; each support block comprises a top surface and a first inclined surface; in the first state, the top surface is in contact with the table body, and the first inclined surface is in contact with the respective support leg.

20 Claims, 6 Drawing Sheets

(56) References Cited

U.S. PATENT DOCUMENTS

| | | | | |
|---|---|---|---|---|
| 2003/0177961 | A1* | 9/2003 | Wang | A47B 3/0818<br>108/130 |
| 2021/0170268 | A1* | 6/2021 | Malki | A63F 9/1044 |
| 2022/0118567 | A1* | 4/2022 | Darling | A47B 1/05 |

* cited by examiner

JIGSAW PUZZLE TABLE

CROSS REFERENCE TO RELATED APPLICATIONS

The present application claims the priority of the Chinese patent application No. 202420950719.0, filed on Apr. 29, 2024, contents of which are incorporated herein by its entireties.

TECHNICAL FIELD

The present disclosure relates to the field of puzzle game accessories, and in particular to a jigsaw puzzle table.

BACKGROUND

Jigsaw puzzles, as a kind of puzzle games, are essential for developing intelligence of children. Due to interests, jigsaw puzzles are also popular among adults. A jigsaw puzzle table is a table that is particularly configured to perform jigsaw puzzle games. Support legs of the jigsaw puzzle table are mostly configured to be inclined. The inclined legs provide better appearance and provide a larger space at a bottom of the table, such that children or adults may move legs and feet when performing the jigsaw puzzle game. In addition, since most of the jigsaw puzzle tables need to be folded and stored, the inclined legs also facilitates the support legs to be rotated for storage.

However, the inclined legs, when being used, are subjected to a force that is applied in an inclined-downward direction. Therefore, the support legs, after being used for a long period of time, may be deformed and damaged.

SUMMARY OF THE DISCLOSURE

The present disclosure provides a jigsaw puzzle table, including: a table body; at least two support legs; and at least two support blocks. Each of the at least two support legs is rotatably connected to the table body; in a first state, each support leg is inclined with respect to the table body and supports the table body. Each of the at least two support blocks is disposed on a respective one of the at least two support legs or on the table body; each support block comprises a top surface and a first inclined surface; in the first state, the top surface is in contact with the table body, and the first inclined surface is in contact with the respective support leg.

DETAILED DESCRIPTION

Figure 1:
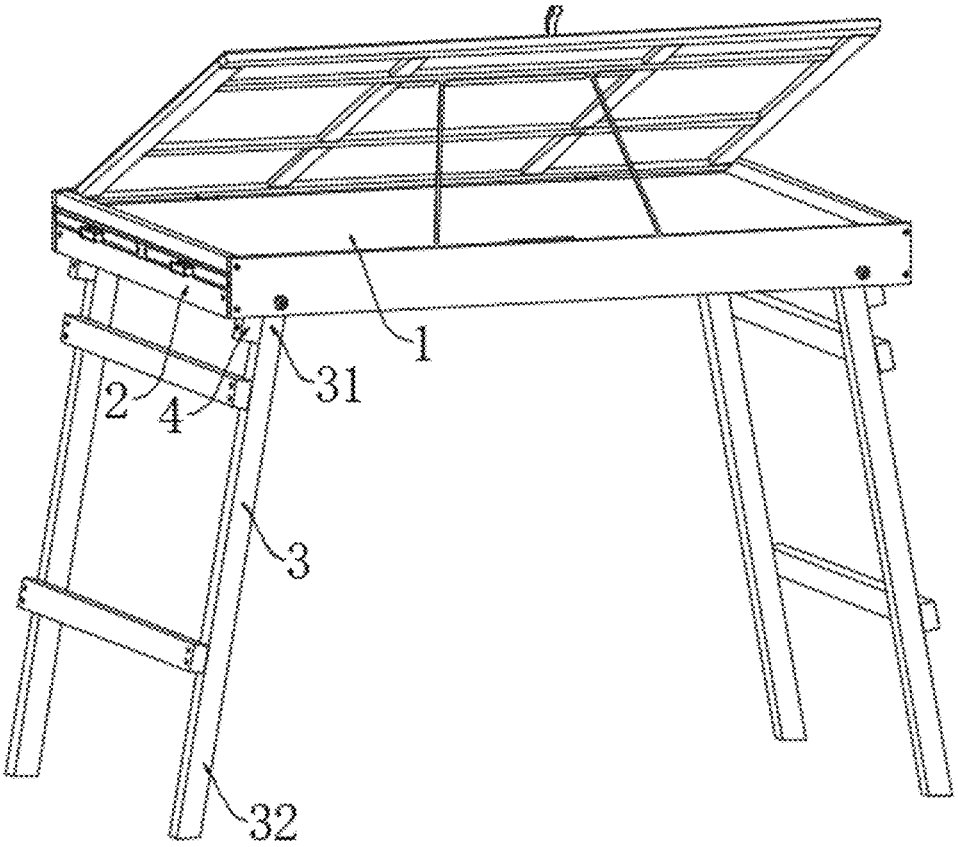
FIG. 1 is a structural schematic view of a jigsaw puzzle table according to an embodiment of the present disclosure.

In order to make purposes, features and advantages of the present disclosure more obvious and understandable, embodiments of the present disclosure will be described in detail by referring to the accompanying drawings in the following.

To be noted that the terms "first", "second", and so on, in the specification, claims and the accompanying drawings of the present disclosure are used to distinguish objects and shall not be interpreted as describing a particular order or sequence. To be understood that data used in such a way may be interchangeable, such that the embodiments of the present disclosure described herein can be implemented in an order other than those illustrated or described herein.

In the description of the present disclosure, it is to be noted that the terms "arranged", "mounted", "connected", "coupled" shall be understood in a broad sense, unless otherwise expressly specified and qualified. For example, connection may be fixed connection, detachable connection, configured as a one-piece structure; or mechanical connection; or direct connection, indirect connection through an intermediate medium; or connection within two elements. Any ordinary skilled person in the art shall understand the specific meaning of the above terms in the context of the present disclosure case by case.

In the description of the present disclosure, "embodiment", "one embodiment", "an embodiment", and so on, means that specific features, structures, materials, or properties described in an embodiment or implementation are included in at least one embodiment or implementation of the present disclosure. In the present specification, schematic expressions of the above terms do not necessarily refer to a same embodiment or implementation. Moreover, the described specific features, structures, materials, or properties may be combined in any one or more of the embodiments or implementations in a suitable manner.

The present disclosure will be described in detail below by referring to the accompanying drawings.

In order to solve the above technical problems, as shown in FIGS. 1, 2, 5 and 6, the present disclosure provides a jigsaw puzzle table including following structure.

A table body 1 is included.

At least two support legs 3 are included. Each support leg 3 is rotatably connected to the table body 1. When the jigsaw puzzle table is in a first state, each support leg 3 is inclined with respect to the table body 1 and supports the table body 1.

At least two support blocks 4 are included. Each of the least two support blocks 4 is disposed on a respective one of the at least two support legs 3; or the least two support blocks 4 are disposed on the table body 1. Each support block 4 includes a top surface 42 and a first inclined surface 41. When the jigsaw puzzle table is in the first state, the top surface 42 contacts the table body 1, and the first inclined surface 41 contacts the respective support leg 3.

To be noted that, at least two support legs 3 are arranged. Each support leg 3 is rotatably connected to the table body 1. In this way, the at least two support legs 3 are inclined with respect to each other and are inclinedly arranged at a bottom of the table body 1 to support the table body 1 from the ground. The support blocks 4 are arranged on the support legs 3 or on the table body 1. Each support block 4 is disposed on a side of the support leg 3 that is rotated outwardly. The first state is a state in which the support legs 3 are unfolded to reach a maximum angle a with respect to the table body 1. In the first state, each support leg 3 abuts against the table body 1 via the respective support block 4. The support block 4 includes the top surface 42 and the first inclined surface 41. The top surface 42 of the support block 4 contacts the table body 1, and the first inclined surface 41 of the support block 4 contacts the support leg 3. An angle between the top surface 42 and the first inclined surface 41 is an acute angle, such that an inclination angle between the support leg 3 and the table body 1 can be adapted. In summary, when an object is carried on the table body 1, the support leg 3 is subjected to a force, and a force F1 that is applying along an inclined downward direction is formed. The force F1 is dispersed to generate an outward force F2. In this way, the support leg 3 may be bent and deformed by the force F2, and may be damaged. By arranging the support block 4, when the support leg 3 is in the first state, the top surface 42 of the support block 4 contacts the table body 1, a portion of the force applied to the support leg 3 may be applied to the support block 4, such that a downward force F3 is formed. The first inclined surface 41 of the support block 4 abuts against the support leg 3. Since the support leg 3 is inclined, the force F3 is dispersed to generate a force F4 that drives the support leg 3 to have a tendency to move inward. In this way, the force F2 applied to the support leg 3 may be attenuated, such that the force applied to the support leg 3 may be alleviated. Therefore, support for the support leg 3 is more stable, and the support leg 3 is less likely to be damaged. Furthermore, the table body 1 is prevented from being bent and deformed due to being abutted against by the support leg 3.

It is understood that when the number of the at least two support legs 3 is two, the at least two support legs 3 are symmetrically disposed at the bottom of the table body 1 along a length direction of the table body 1. When the number of the at least two support legs 3 is four as shown in FIG. 1, the four support legs 3 are symmetrically disposed at the bottom of the table body 1 along the length direction of the table body 1, where two of the four support legs 3 are disposed at one side, and the other two of the four support legs 3 are disposed at the other side, such that the four support legs 3 inclinedly support four corners of the table body 1 from the ground. When the table body 1 is in a large size, the number of the at least two support legs 3 may be six. In summary, the number of the at least two support legs 3 can be determined according to the actual demands, which will not be specifically limited.

Figure 2:
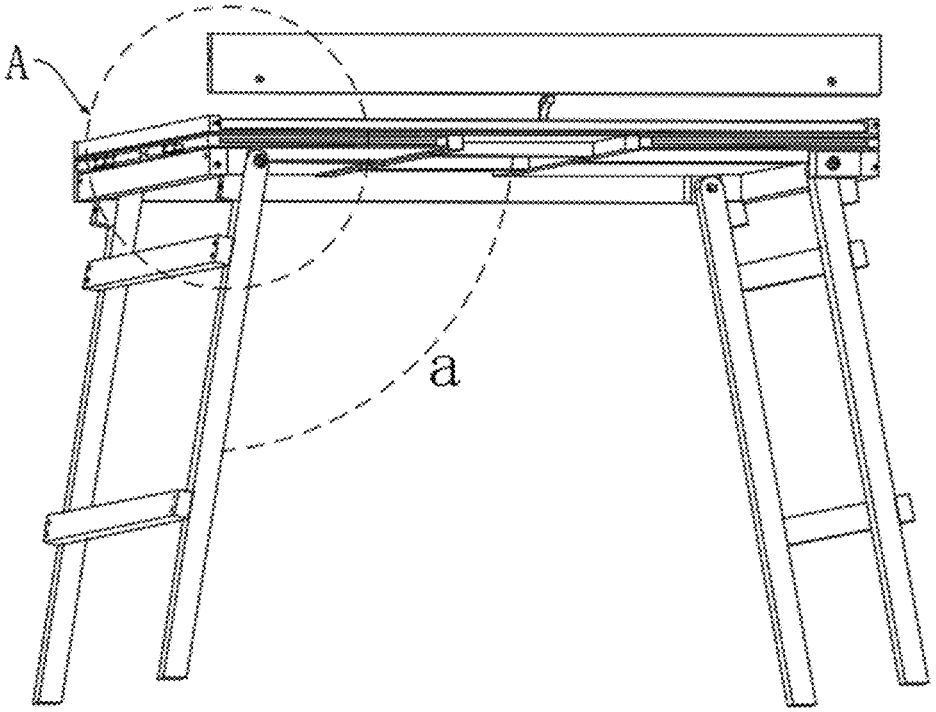
FIG. 2 is an exploded view of the jigsaw puzzle table according to an embodiment of the present disclosure.

In an embodiment, as shown in FIGS. 1 and 2, the support leg includes a first end 31. The first end 31 is rotatably connected to the table body 1. The support block 4 is disposed on the first end 31. In the first state, the top surface 42 of the support block 4 contacts the table body 1.

To be noted that when the support block 4 is disposed on the support leg 3, the support leg 3 includes the first end 31 and a second end 32 that is supported to the ground. The support block 4 is disposed to the first end 31 of the support leg 3 by a fastener 8, such as a screw, such that the support block 4 rotates relative to the table body 1 as the support leg 3 rotates. When the support block 4 is disposed on the first end 31, the support block 4 is disposed near the table body 1. In this way, the top surface 42 of the support block 4 is enabled to contact the table body 1, further reducing a size of the support block 4. In the first state, the top surface 42 of the support block 4 is moved to a state of contacting the table body 1, such that the above-mentioned supporting the table body is achieved. In this way, when the support leg 3 is rotated to be stored, the support block 4 is accordingly stored, and a better appearance is achieved.

In an embodiment, as shown in FIGS. 1 and 2, the support block 4 is disposed on the table body 1. In this case, in the first state, the first inclined surface 41 of the support block 4 contacts the support leg 3.

To be noted that, the support block 4 may be mounted in another manner. The support block 4 is disposed on the table body 1 by the fastener 8 such as the screw. In this way, the support block 4 is fixedly arranged and does not rotate when the support leg 3 is rotating. A side of the support block 4 facing towards the support leg 3 is inclined, serving as the first inclined surface 41. An inclination angle of the first inclined surface 41 matches the maximum angle a between the support leg 3 and the table body 1. Therefore, in the first state, the support leg 3 can be moved to a position where the support leg 3 contacts the first inclined surface 41. In this way, the support block 4 can be mounted and fixed easily.

Figure 3:
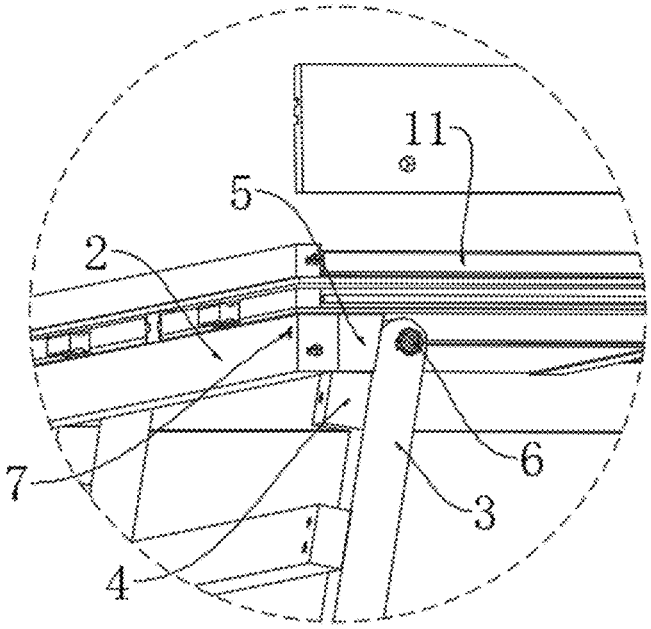
FIG. 3 is an enlarged view of a portion A in FIG. 2.
Figure 5:
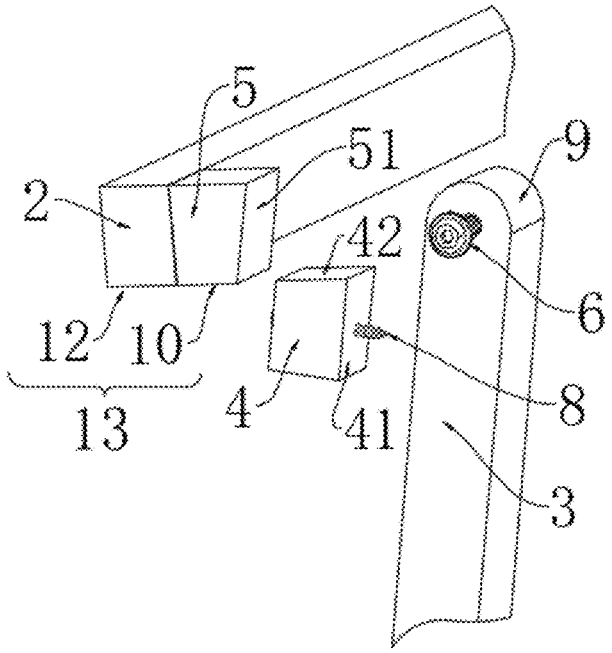
FIG. 5 is a structural schematic view of a portion of the jigsaw puzzle table according to an embodiment of the present disclosure.
Figure 6:
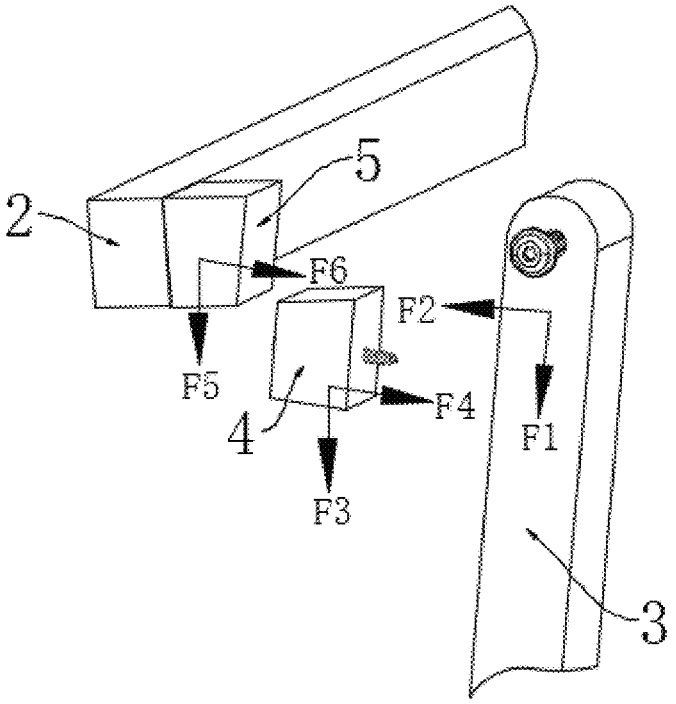
FIG. 6 is a view of force analysis about a portion of the jigsaw puzzle table according to an embodiment of the present disclosure.

In an embodiment of the present disclosure, as shown in FIGS. 3, 5 and 6, the table body 1 includes following structures.

A carrying board 11 is included.

A support frame 2 is included and is disposed at a circumferential side of the carrying board 11.

At least two limiting blocks 5 are arranged. Each of the at least two limiting blocks 5 is disposed between a respective one of the at least two support legs 3 and the support frame 2. A side of the limiting block 5 facing towards the support leg 3 is a second inclined surface 51. In this way, the inclination angle of the support leg 3 with respect to the table body 1 is limited.

To be noted that, the limiting block 5 is disposed between the support leg 3 and the support frame 2. The side of the limiting block 5 near the support leg 3 is inclined to form the second inclined surface 51. An inclination angle of the second inclined surface 51 matches the maximum angle a between the support leg 3 and the table body 1. In this way, the second inclined surface 51 may contact the support leg 3 along an inclined direction to limit the maximum angle a between the support leg 3 and the table body 1. When the limiting block 5 is subjected to a downward force F5 applied from the table body, the first inclined surface 51 of the limiting block 5 transmits a force dispersed from the force F5 to the support leg 3, i.e., a force F6, which allows the support leg 3 to rotate back towards the table body, is formed. In this way, the limiting block 5 also prevents the support leg 3 and the table body 1 from being damaged.

In an embodiment of the present disclosure, shown in FIGS. 3, 5 and 6, when the support block 4 is disposed on the table body 1, the support block 4 is disposed on a bottom surface 10 of the limiting block 5; and/or the support block 4 is disposed on a bottom surface 12 of the support frame 2.

To be noted that when the support block 4 is disposed on the table body 1, in one embodiment, the support block 4 is disposed on the bottom surface 10 of the limiting block 5. In this way, the support block 4 is disposed closer to the first end 31 of the support leg 3, enabling the size of the support block 4 to be further reduced. In another embodiment, the support block 4 is disposed on the bottom surface 10 of the limiting block 5 and on the bottom surface 12 of the support block 2. In this case, a contact area between the limiting block 5 and the table body 1 is maximized, such that a larger downward force is withstandable, the force applied to the support leg 3 is alleviated more significantly. In still another embodiment, the top surface 42 of the support block 4 contacts the bottom surface 12 of the support frame 2 without contacting the bottom surface 10 of the limiting block 5. In this case, the limiting block 5 may be omitted, and the overall structure of the table is simplified.

In an embodiment of the present disclosure, as shown in FIG. 5, when the support block 4 is disposed on the support leg 3, and the support leg 3 is in the first state, the top surface 42 of the support block 4 contacts the bottom surface 10 of the limiting block 5; and/or the top surface 42 of the support block 4 contacts the bottom surface 12 of the support frame 2.

To be noted that, similarly, when the support block 4 is disposed on the support leg 3 and is rotated to the first state as the support leg 3 rotates, in an embodiment, the top surface 42 of the support block 4 contacts the bottom surface 10 of the limiting block 5. Similarly, the size of the support block 4 is reduced. In another embodiment, the top surface 42 of the support block 4 contacts the bottom surface 10 of the limiting block 5 and the bottom surface 12 of the support frame 2. Similarly, in this case, the contact area between the limiting block 5 and the table body 1 is increased, such that the support block 4 can withstand a larger downward force F3. In still another embodiment, the top surface 42 of the support block 4 contacts the bottom surface 10 of the support frame 2. Similarly, in this case, the limiting block 5 may be omitted, and the overall structure of the table is simplified.

In an embodiment of the present disclosure, as shown in FIG. 5, the table body 1 includes a bottom surface 13. At least a portion of the bottom surface 13 is flat to be attached to the top surface 42 of the support block 4. The first inclined surface 41 and the second inclined surface 51 are aligned with each other to be attached to the support leg 3.

To be noted that the bottom surface 13 includes the bottom surface 12 of the support frame 2 and the bottom surface 10 of the limiting block 5. The bottom surface 13 is flat, i.e., the bottom surface 12 of the support block 2 being aligned with the bottom surface 10 of the limiting block 5. The top surface 42 of the support block 4 is also flat to be attached to the bottom surface 13 to achieve a maximum contact area, such that a capacity of being withstanding forces is increased, and mutual support stability is improved. The first inclined surface 41 and the second inclined surface 51 are aligned to each other in the inclining direction. When the support leg 3 has a squared circumference, the side of the support leg 3 is flat. In this way, the first inclined surface 41 and the second inclined surface 51 can be attached to the support leg 3, further increasing a force receiving area between the first inclined surface 41, the second inclined surface 51, and the support leg 3. Therefore, the overall structure of the table is more stable. When the support leg 3 is cylindrical, the side of the support leg 3 is curved. The first inclined surface 41 and the second inclined surface 51 are configured in a curved shape to match with the circumferential shape of the support leg 3. It is understood that shapes of the first inclined surface 41 and the second inclined surface 51 may be adaptively changed according to a shape of the circumference of the support leg 3, which will not be limited herein.

In an embodiment of the present disclosure, as shown in FIGS. 3 and 5, the limiting block 5 is disposed on the support frame 2, and an end face of the first end 31 of the support leg 3 is a curved surface 9, such that a rotational gap is defined between the support leg 3 and the limiting block 5.

To be noted that the limiting block 5 is disposed on the support frame 2, and the end face of the first end 31 of the support leg 3 is the curved surface 9. In this way, the rotational gap is left between the curved surface 9 and the limiting block 5 when the support leg is rotating inward to be stored. When the support leg 3 is rotated outwardly to reach the maximum angle a with respect to the table body, the support leg 3 contacts the second inclined surface 51.

In an embodiment of the present disclosure, as shown in FIG. 1, four support legs 3 are arranged. The support frame 2 includes: two first side panels 21 that are disposed corresponding to each other; and two second side panels 22 that are disposed corresponding to each other. Each support leg 3 is rotatably arranged to a respective one of the two first side panels 21, and two of the four support legs 3 are symmetrical to the other two of the four support legs 3.

Figure 4:
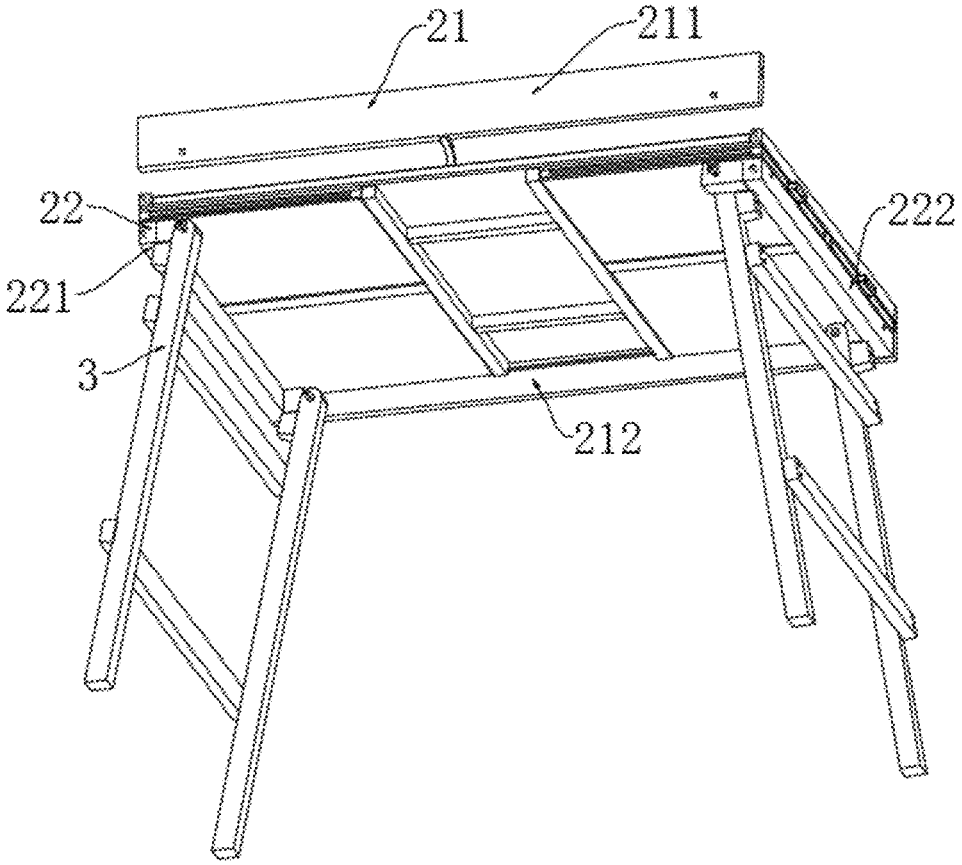
FIG. 4 is another exploded view of the jigsaw puzzle table according to an embodiment of the present disclosure.

To be noted that when four support legs 3 are arranged, the support frame 2 includes: two first side panels 21 that are disposed corresponding to each other, i.e., a front side panel 211 and a rear side panel 212; and two second side panels 22 that are disposed corresponding to each other, i.e., a left side panel 221 and a right side panel 222, as shown in FIG. 4. Two of the four support legs 3 are symmetrical to the other two of the four support legs 3, the two of the four support legs 3 and the other two of the four support legs 3 are correspondingly rotatably arranged on the front side panel 211 or the rear side panel 212. When each support leg 3 reaches the maximum angle a with respect to the table body, each support leg 3 inclinedly abuts against the respective left side panel 221 or the respective right side panel 222 adjacent thereto. In this way, the support leg 3 can be mounted by a connection member 6 directly extending through the respective front side panel 211 or the respective rear side panel 212. Therefore, the support leg 3 rotates by taking the connection member 6 as a rotation shaft, the overall structure of the table is simple, and the table can be assembled conveniently.

Figure 7:
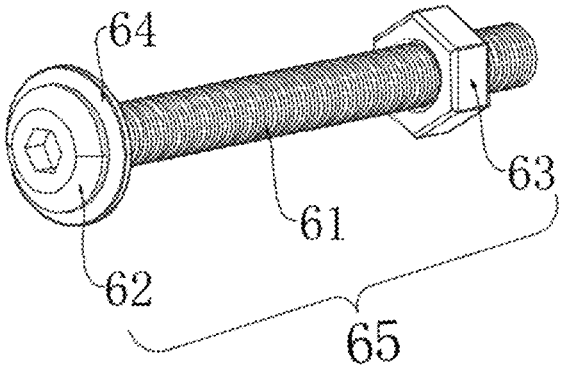
FIG. 7 is a structural schematic view of a connection member according to an embodiment of the present disclosure.

In an embodiment of the present disclosure, as shown in FIGS. 5 and 7, the connection member 6 includes following structure.

A bolt 65 is arranged and includes a head portion 62 and a rod portion 61. The rod portion 61 extends through the first side panel 21 and the support leg 3 successively.

A pad 64 is disposed between the first side panel 21 and the head portion 62 of the bolt 65.

To be noted that, the bolt 65 includes the head portion 62 and the rod portion 61, and the rod portion 61 extends through the first side panel 21 and the support leg 3 successively. In this way, the support leg 3 rotates by taking the rod portion 61 as a rotation shaft. A tail portion of the bolt 65 is arranged with a nut 63 for fastening. The pad 64 is disposed between the first side panel 21 and the head portion 62 of the bolt 65. In this way, when the support leg 3 is made of wood or other material that can be easily deformed, the head portion 62 is prevented from damaging the support leg 3 due to constant rotation of the bolt 65, such that a hole in which the rod portion 61 extends may not be enlarged, and the bolt 65 may not be loosened. The pad 64 is disposed between the head portion 62 and the support leg 3, increasing mounting stability of the support leg 3.

Figure 8:
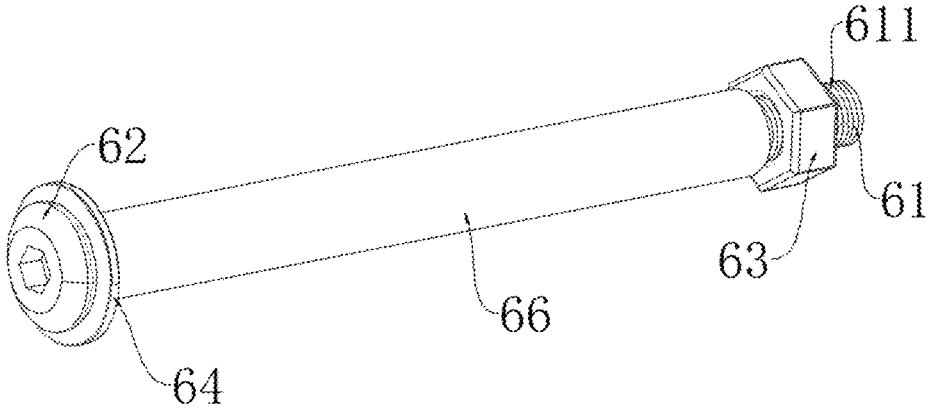
FIG. 8 is another structural schematic view of a connection member according to an embodiment of the present disclosure.

In an embodiment of the present disclosure, as shown in FIG. 8, the connection member 6 further includes a sleeve 66. The sleeve 66 sleeves the rod portion 61. An end 63 of the rod portion 61 away from the head portion 62 is exposed out of the sleeve 66.

To be noted that, the sleeve 66 is made of a rigid material, such as metal alloy or the like. The sleeve 66 sleeves the rod portion 61. The sleeve 66 and the rod portion 61 of the bolt 65 are enabled to extend through the first side panel 21 and the support leg 3 by applying a pressure, such as using an air gun. The end 63 of the rod portion 61 away from the head portion 62 is exposed out of the sleeve 66, such that the end 63 may be threaded with the nut 63 to fasten the bolt 65. Since a surface of the sleeve 66 is smooth, when the support leg 3 is made of wood or other material that can be easily deformed, the hole through which the rod portion 61 extends is prevented from being enlarged due to constant rotation and friction between the support leg 3 and the rod portion 61, such that the bolt 65 is prevented from being loosened. In summary, arranging the sleeve 66 further increases the mounting stability of the support leg 3.

Figure 9:
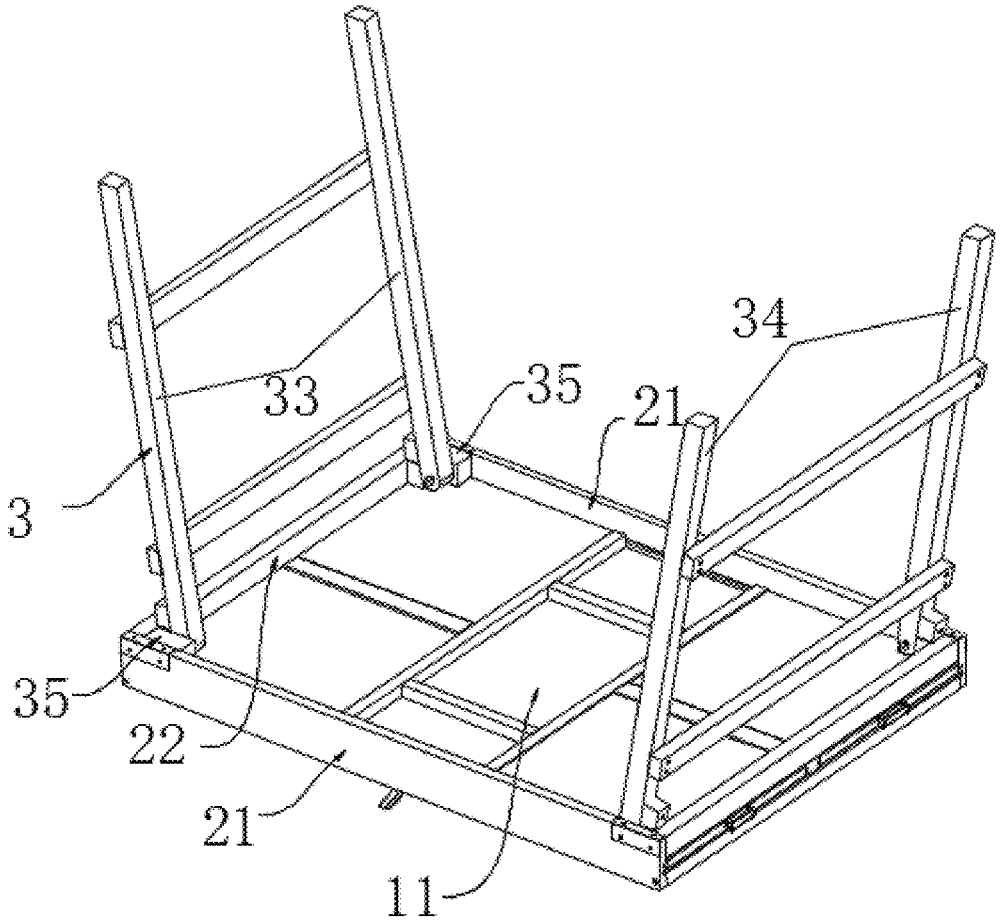
FIG. 9 is another structural schematic view of the jigsaw puzzle table according to an embodiment of the present disclosure.

In an embodiment of the present disclosure, as shown in FIG. 9, two of the four support legs 3 form a first set of support legs 33 and, the other two of the four support legs 3 form a second set of support legs 34 In the first state, the first set of support legs 33 is inclined towards a respective one of the two second side panel 22 that is located adjacent to the first set of support legs 33. An adjustment block 35 is disposed between each support leg of the first set of support legs 33 and a respective one of the two first side panels 21 located adjacent thereto. In a second state, the first set of support legs 33 and the second set of support legs 34 are staggered to each other and are folded to be disposed on the carrying board 11.

To be noted that the first state is the state in which the support legs 3 are inclined to support the table body 1; and the second state is a state in which the first set of support legs 33 and the second set of support legs 34 are rotated and folded to be disposed on the carrying board 11. In the first state, the two support legs 3 inclined towards one of the two second side panels 22 are the first set of support legs 33, and the other two support legs 3 inclined towards the other one of the two second side panels 22 are the second set of support legs 34. The adjustment block 35 is disposed between each support leg of the first set of support legs 33 and a respective one of the two first side panels 21 located adjacent thereto. In this way, a width between the two support legs of the first set of support legs 33 is less than a width of between the two support legs of the second set of support legs 34, such that the first set of support legs 33 and the second set of support legs 34 are staggered to each other and are folded to be disposed on the carrying board 11. When the table is not in use, the support legs 3 are received to be stored.

Figure 10:
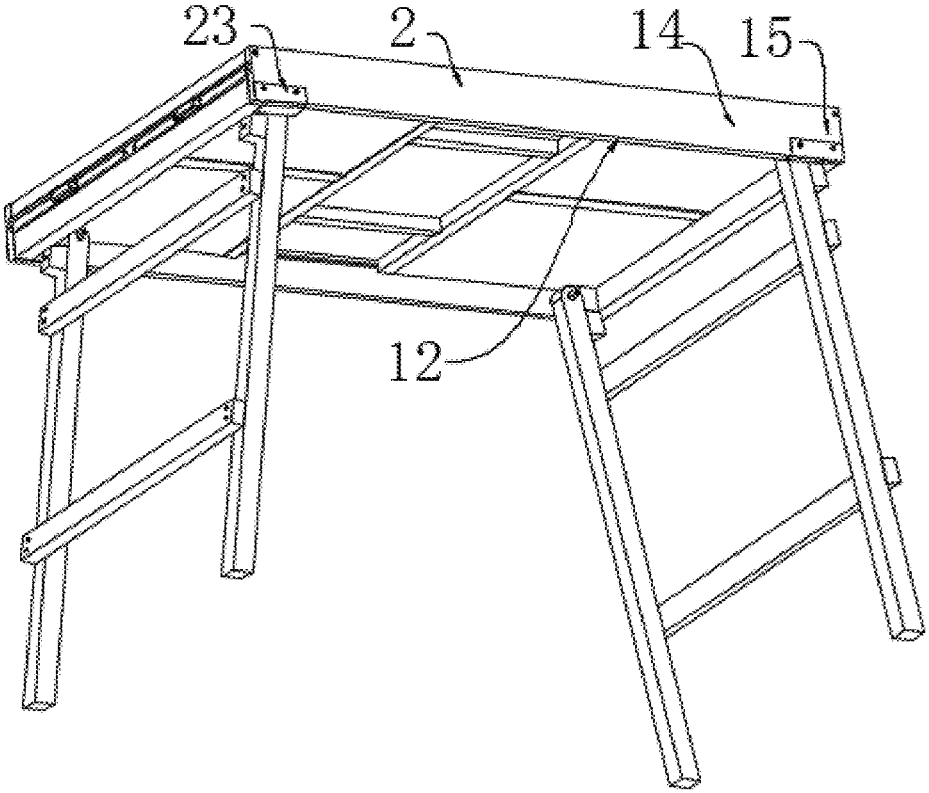
FIG. 10 is still another structural schematic view of the jigsaw puzzle table according to an embodiment of the present disclosure.

In an embodiment of the present disclosure, as shown in FIG. 10, a plurality of pads 23 are arranged. each of the plurality of pads 23 is arranged on a corner 15 of the support frame 2 and is attached to the bottom surface 12 of the support frame 2.

To be noted that, in some embodiments, the pad 23 is arranged on the corner 15 of the support frame 2 and is at least partially attached to the bottom surface 12 of the support frame 2. In this way, rigidity of the corner 15 of the support frame 2 is improved by the pad 23, preventing the corner 15 of the support frame 2 from being damaged by knocking due to the support legs 3 being folded.

Figure 11:
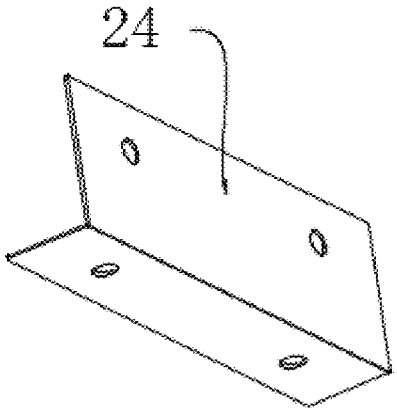
FIG. 11 is a structural schematic view of an L-shaped pad according to an embodiment of the present disclosure.

In an embodiment of the present disclosure, as shown in FIGS. 10 and 11, the pad 23 is an L-shaped pad 24. The support frame 2 further includes a side surface 14, and the L-shaped pad 24 is attached to the bottom surface 12 and the side surface 14 of the support frame 2 to prevent falling damage.

To be noted that, in some embodiments, the pad 23 is the L-shaped pad 24, and the L-shaped pad 24 is attached to the bottom surface 12 and the side surface 14 of the support frame 2. In this way, the bottom surface 12 of the support frame 2 is protected. In addition, when the user tilts the table body 1 to the ground in order to fold the support legs 3, the side surface 14 of the support frame 2 also touches the ground, and in this case, the L-shaped pad 24 is arranged to protect the side surface 14 of the support frame 2.

To be noted that the above technical features can be further combined with each other to form various more embodiments which are not listed in the above, and the more embodiments are within the scope of the present disclosure. Furthermore, any ordinary skilled person in the art may perform improvement or transformation according to the above specification, and the improvement and the transformation shall fall within the scope of the claims of the present application.

What is claimed is:

1. A jigsaw puzzle table, comprising:

a table body;

at least two support legs, wherein, each of the at least two support legs is rotatably connected to the table body; in a first state, each support leg is inclined with respect to the table body and supports the table body;

at least two support blocks, wherein, each of the at least two support blocks is disposed on a respective one of the at least two support legs or on the table body; each support block comprises a top surface and a first inclined surface; in the first state, the top surface is in contact with the table body, and the first inclined surface is in contact with the respective support leg;

wherein the at least two support legs comprise a first support leg and a second support leg, the first support leg is configured to rotate in a first direction to support the table body, the second support leg is configured to rotate in a second direction to support the table body, the second direction is different from the first direction;

the first support leg comprises a first inner face facing towards the second support leg and a first side face that does not face towards the second support leg; the second support leg comprises a second inner face facing towards the first support leg and a second side face that does not face towards the first support leg;

one of the at least two support blocks is arranged on the first side face, and another one of the at least two support blocks is arranged on the second side face.

2. The jigsaw puzzle table according to claim 1, wherein, for each of the at least two support legs and the respective a of the at least two support blocks, the support leg comprises a first end, the first end is rotatably connected to the table body, the support block is arranged on the first end:

in the first state, the top surface of the support block is in contact with the table body.

3. The jigsaw puzzle table according to claim 2, wherein, the support block is configured to move, as the support leg rotates, relative to the table body.

4. The jigsaw puzzle table according to claim 1, wherein, for each of the at least two support legs and the respective a of the at least two support blocks, the support block is disposed on the table body: in the first state, the first inclined surface of the support block is in contact with the support leg.

5. The jigsaw puzzle table according to claim 4, wherein, an angle between the first inclined surface of the support block and the table body matches with a maximum angle that the support leg is rotated to reach with respect to the table body.

6. The jigsaw puzzle table according to claim 1, wherein, for each of the at least two support legs, the table body comprises a bottom surface; at least a portion of the bottom surface is flat to be attached to the top surface of the support block: the first inclined surface and the second inclined surface are aligned to each other to cooperatively form a flat surface to be attached to the support leg.

7. A jigsaw puzzle table, comprising:

a table body;

at least two support legs, wherein, each of the at least two support legs is rotatably connected to the table body; in a first state, each support leg is inclined with respect to the table body and supports the table body;

at least two support blocks, wherein, each of the at least two support blocks is disposed on a respective one of the at least two support legs or on the table body; each support block comprises a top surface and a first inclined surface; in the first state, the top surface is in contact with the table body, and the first inclined surface is in contact with the respective support leg;

wherein the table body comprises:

a carrying board;

a support frame, disposed at a circumferential side of the carrying board;

at least two limiting blocks, wherein, each of the at least two limiting blocks is disposed between a respective one of the at least two support legs and the support frame, a side of the limiting block facing towards the respective support leg is a second inclined surface configured to limit an inclination angle of the respective support leg.

8. The jigsaw puzzle table according to claim 7, wherein, when the support block is disposed on the table body, the support block is arranged on a bottom surface of the limiting block.

9. The jigsaw puzzle table according to claim 7, wherein, when the support block is disposed on the table body, the support block is arranged on a bottom surface of the support frame.

10. The jigsaw puzzle table according to claim 7, wherein, when the support block is disposed on the table body, the support block is arranged on a bottom surface of the limiting block and a bottom surface of the support frame.

11. The jigsaw puzzle table according to claim 7, wherein, when the support block is disposed on the support leg, in the first state, the top surface of the support block is in contact with a bottom surface of the limiting block.

12. The jigsaw puzzle table according to claim 7, wherein, when the support block is disposed on the support leg, in the first state, the top surface of the support block is in contact with the bottom surface of the support frame.

13. The jigsaw puzzle table according to claim 7, wherein, the limiting block is arranged on the support frame, an end face of the first end of the support leg is a curved surface, and a rotational gap is defined between the curved surface and the limiting block.

14. The jigsaw puzzle table according to claim 7, wherein the at least two support legs comprise four support legs, wherein, the support frame comprises: two first side panels that are disposed corresponding to each other; and two second side panels that are disposed corresponding to each other:

each support leg is rotatably arranged on a respective one of the two first side panels by a connection member.

15. The jigsaw puzzle table according to claim 14, wherein, the connection member comprises:

a bolt, comprising a head portion and a rod portion: wherein, the rod portion extends through the first side panel and the support leg successively; and a pad, disposed between the first side panel and the head portion of the bolt.

16. The jigsaw puzzle table according to claim 15, wherein, the connection member further comprises a sleeve: the sleeve sleeves the rod portion: an end of the rod portion away from the head portion is exposed out of the sleeve.

17. The jigsaw puzzle table according to claim 14, wherein, the number of the at least two support legs is four, two of the four support legs form a first set of support legs, the other two of the four support legs form a second set of support legs;

in the first state, the first set of support legs is inclined towards a respective one of the two second side panel that is located adjacent to the first set of support legs; an adjustment block is disposed between each support leg of the first set of support legs and the respective first side panel located adjacent thereto; and in a second state, the first set of support legs and the second set of support legs are staggered to each other and are folded to be disposed on the carrying board.

18. The jigsaw puzzle table according to claim 17, wherein, a width between the two support legs of the first set of support legs is less than a width of between the two support legs of the second set of support legs.

19. The jigsaw puzzle table according to claim 7, further comprising a plurality of pads, wherein, each of the plurality of pads is arranged on a corner of the support frame and is attached to the bottom surface of the support frame.

20. The jigsaw puzzle table according to claim 19, wherein, the pad is an L-shaped pad; the support frame further comprises a side surface; the L-shaped pad is attached to the bottom surface and the side surface of the support frame to prevent damage due to falling.

* * * * *